US006751887B2

(12) United States Patent
Hanhi

(10) Patent No.: US 6,751,887 B2
(45) Date of Patent: Jun. 22, 2004

(54) METHOD AND SYSTEM FOR DRYING MATERIAL

(75) Inventor: Kalle Hanhi, Nokia (FI)

(73) Assignee: Lahden Ammattikorkeakoulu, Lahti (FI)

( * ) Notice: Subject to any disclaimer, the term of this patent is extended or adjusted under 35 U.S.C. 154(b) by 0 days.

(21) Appl. No.: 10/381,143

(22) PCT Filed: Sep. 20, 2001

(86) PCT No.: PCT/FI01/00822

§ 371 (c)(1),
(2), (4) Date: Sep. 9, 2003

(87) PCT Pub. No.: WO02/25191

PCT Pub. Date: Mar. 28, 2002

(65) Prior Publication Data

US 2004/0035020 A1 Feb. 26, 2004

(30) Foreign Application Priority Data

Sep. 21, 2000 (FI) ..... 20002085

(51) Int. Cl.[7] ..... F26B 3/34

(52) U.S. Cl. ..... 34/250; 34/248; 34/255; 34/257

(58) Field of Search ..... 34/245, 248, 250, 34/253, 255, 257, 263; 219/770, 774, 777

(56) References Cited

U.S. PATENT DOCUMENTS

| | | | | | |
|---|---|---|---|---|---|
| 3,798,784 | A | * | 3/1974 | Kovats et al. | 34/257 |
| 3,955,286 | A | | 5/1976 | Anrep | |
| 3,986,268 | A | | 10/1976 | Koppelman | |
| 4,466,198 | A | | 8/1984 | Doll | |
| 4,567,340 | A | * | 1/1986 | Latchum, Jr. | 219/701 |
| 4,622,446 | A | | 11/1986 | Sugisawa et al. | |
| 5,193,290 | A | | 3/1993 | Tolson | |

FOREIGN PATENT DOCUMENTS

| | | |
|---|---|---|
| WO | 99/18401 | 4/1999 |
| WO | 00/19159 | 4/2000 |
| WO | 00/50207 | 8/2000 |

* cited by examiner

*Primary Examiner*—Jiping Lu
(74) *Attorney, Agent, or Firm*—Young & Thompson

(57) ABSTRACT

A system for dying material, in which system the material to be dried is located in a drying space isolated from its surroundings, in which space drying is done by way of negative pressure and a high-frequency electromagnetic field generated by electrodes. The drying space used is a drying batch-specific film package that is substantially separate from the rest of the equipment and that can be brought to an electromagnetic field generated by external electrodes. The film package serving as the drying space comprises nozzles, and for the period of drying, the package can be connected by tubes from the nozzles to equipment for removing moisture released from the material.

13 Claims, 3 Drawing Sheets

METHOD AND SYSTEM FOR DRYING MATERIAL

Figure 1:
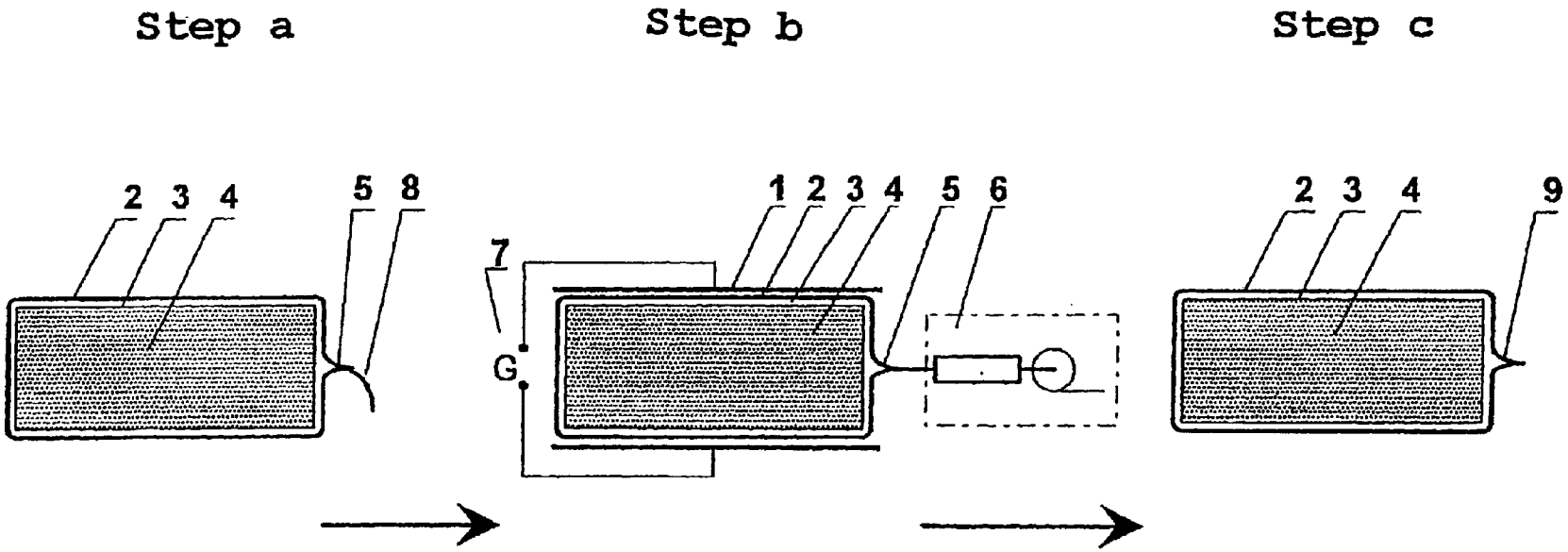

The invention relates to a method and system for drying material, in which the material is dried by means of negative pressure and a high-frequency electromagnetic field generated by electrodes in a space isolated from its surroundings.

Drying techniques exist that try to shorten the drying times of materials using negative pressure and micro-wave heating. These drying systems use different types of fixed autoclaves and different systems for discharging the material being dried into the external pressure. In these prior-art solutions, the electrodes generating the high-frequency field are normally attached to the autoclave. The fixed structure of the known systems limits the modifiability of the drying systems for pieces of different sizes and shapes and also constitutes a heavy assembly which is not easy to move.

Published U.S. Pat. No. 4466198 describes a drying system in which the material to be dried is, instead of a rigid-structure autoclave, enclosed in a flexible covering to which a first electrode is attached while a second electrode resides outside the covering. Moisture from the lumber being dried is led out of the covering through the first electrode. The described system is a lighter and easier-to-move application than the previous drying systems, but its drawback is still a fixed drying space; the covering is at its lower part attached to the lower electrode and it cannot be moved independently in relation to the electrodes. The material to be dried is thus placed into the drying space and removed from it after the drying ends, so the system does not enable a continuous flow of material being dried through the electrodes, or the storage of the material in a closed drying space after the drying.

It is an object of the invention to develop a drying method and drying system so as to solve the above-mentioned problems. The object of the invention is achieved by a method and system which are characterized by what is stated in the independent claims. Preferred embodiments of the invention are set forth in the dependent claims.

The invention is based on using as drying space a drying batch-specific film package substantially separate from the rest of the equipment. During drying, a negative pressure is provided in the film package and the material in the package is subjected to an electromagnetic field generated by external electrodes. For the period of drying, the film package is connected through movable hoses to equipment for removing moisture from the package. After drying, the film package is removed from the drying system and it can be used to protect the material in storage or transport.

The system of the invention provides the advantage that it is simple and light and the drying batch-specific film packages can be moved, which makes it possible to convey material batches packed in film packages continuously or in stages through the effective area of the electrodes. Because the drying space formed by the film package is drying batch-specific and separate from the rest of the equipment, material can after drying also be stored in the film package for transport, storage or evening-out of moisture. Products dried and packaged in manufacturing by means of the method of the invention keep without the damaging effect of micro-organisms until they are taken into use. The system of the invention also provides the advantage that it is suited for field use, because the separate parts of the system are easy to move and to construct onto a conveying means. The drying system of the invention is also easily modifiable for material pieces of different sizes and shapes, since contrary to the prior art, the dimensions of the piece to be dried are not limited by the drying space. An additional advantage of the system of, the invention is that measurement is easy, because the material to be dried is not surrounded by fixed and heavy structures hampering measurement.

Figure 2:
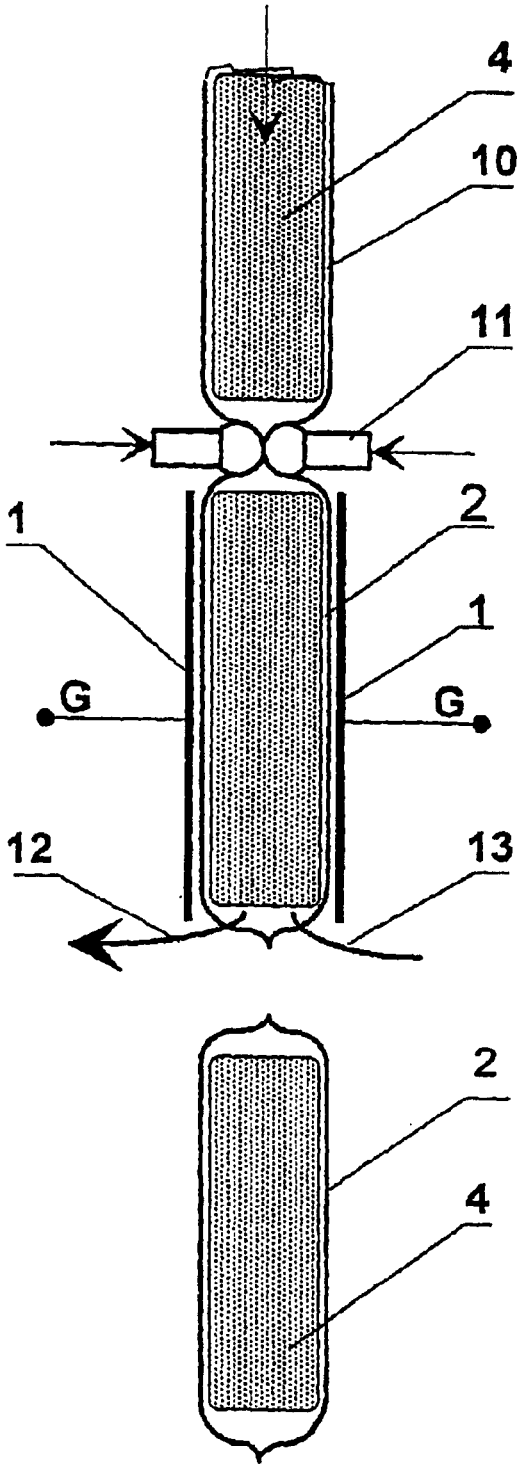
Figure 3:
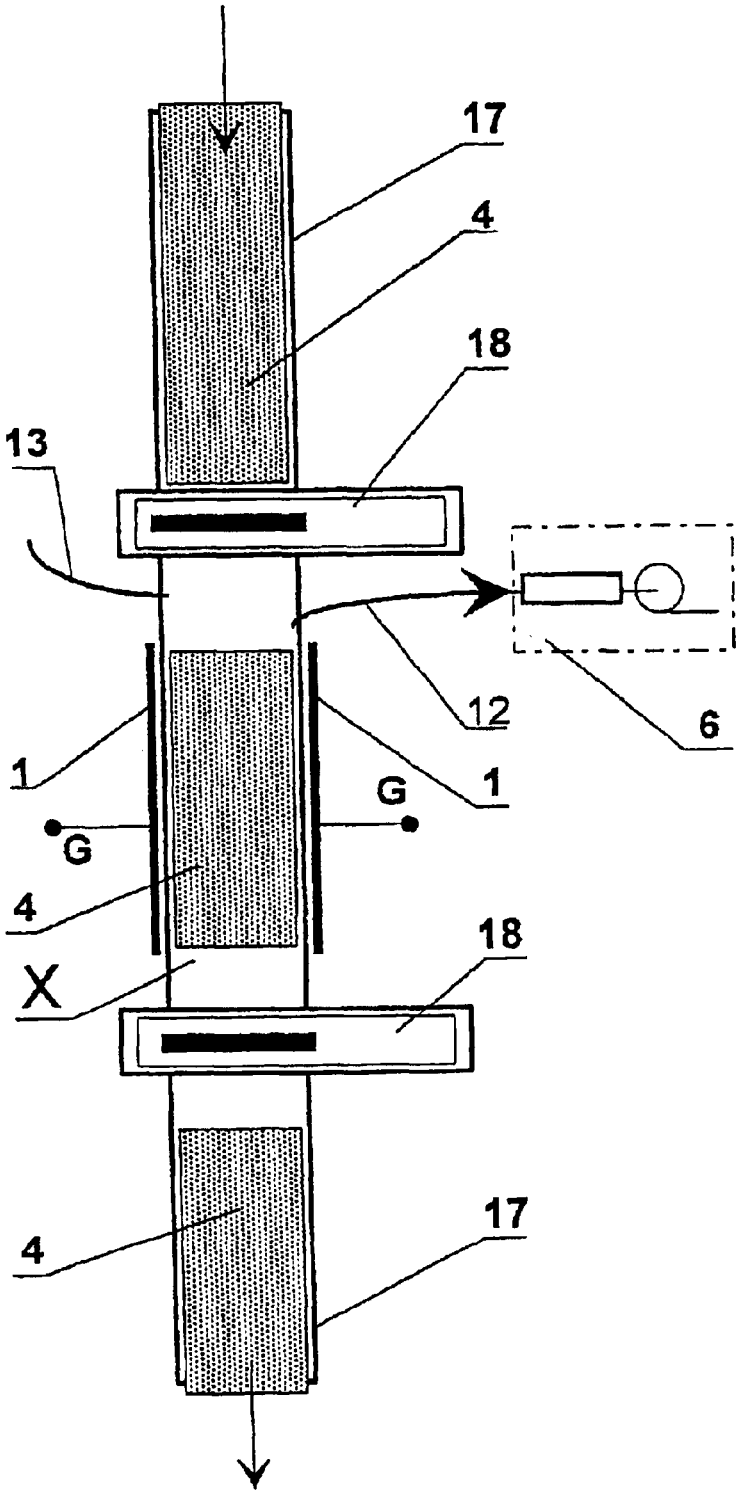

The invention will now be described in more detail by means of a preferred embodiment and with reference to the attached drawing, in which FIG. 1 shows a method of the invention for drying material, FIG. 2 shows an embodiment of the system of the invention, FIG. 3 shows a second embodiment of the system of the invention.

FIG. 1 shows three drying steps a to c. In the first step a, material 4 is enclosed in a separate film package 2. The film package 2 is a hermetically sealed package made of a material suited for a micro wave field. The shape of the film package can correspond to that of the piece to be dried. The material of the film package can be plastic, thermoelastic or rubber. The wall thickness of the film package is selected to endure the load generated by a pressure difference and depending on the application, to meet any criteria set by transport and storage. The material 4 to be dried is in the film package 2 preferably in such a manner that the material and package do not come in contact with each other, which makes moisture removal from the material being dried possible. The contact of the surfaces can be prevented using a filler 3, such as foam, or structures, such as netting or laths, between the material and the inner surface of the film package. The film package can also be stretched so that a required space remains between the inner surface of the film and the material. If the material to be dried is porous or contains cavities, no empty space is needed between the film and the material.

In step b, the film package is brought between the electrodes 1 and the film package is connected to equipment 6 by means of nozzles 5 in the film package to generate a negative pressure and to remove water or water vapour. The equipment 6 also performs other automatic functions required in drying, and sampling for different measurements can be done through the leading-through of the nozzles. The equipment 6 and the nozzles 5 in the film package are connected through hoses 8 in such a manner that the hoses can move with the film package in the high-frequency field. The hose system can also be multi-branched, thus enabling the use of one piece of equipment 6 for drying several film packages 2. The nozzles 5 in the film package can form a tight bayonet connection to the equipment so that the package can easily or automatically be connected to or disconnected from the equipment 6. The electrodes 1 generating the electromagnetic field are shaped disc-like pieces located in such a manner that the film package with hoses connected to it can be brought within the magnetic field generated by the electrodes. The drying system can be built in such a manner that film packages with their hoses are moved through the effective area of stationary electrodes in stages or continuously at a rate suitable for drying. Another alternative is that the electrodes are moved in relation to the stationary film package and the required electromagnetic field is directed to the package or a part of it. It is also possible to make the drying system such that both the film package and the electrodes move at an appropriate rate or that both components are arranged to be stationary in the same place. All above construction alternatives for the drying system can be implemented in such a manner that the size of the effective area of the electrodes can be altered according to the size and shape of the film package to be dried. When drying several film packages, they can be brought within the electromagnetic field one after the other and/or in groups, and an automatic function can be added to the system to connect and disconnect the film packages being dried.

In the last step c, the film package 2 is disconnected from the equipment 6 and taken away from the effective area of the electrodes. The material can now be transported and stored in the tight film package. If necessary, after drying, the material can also be left inside the film package so that moisture can even out after drying. Gas or vapour can later be removed from the film package through the nozzles of the film package or if necessary, gas or liquids can be added into the package for treating the material.

FIG. 2 shows one preferred embodiment in which the film package 2 is made of a film pipe 10 filled with the material during drying. The material 4 is fed into a pipe-like space 10 and a drying space 2 that fits between the electrodes 1 is formed by a press 11. Equipment 6 is connected to the drying space 2, as in FIG. 1, but only the outlet 12 is shown in FIG. 2. Reference numeral 13 shows other possible inlets connected to the drying space 2 for measurements or for dosing gas and liquids into the drying space. The press 11 preferably also comprises a seaming and cutting apparatus so that the drying space 2 can be disconnected into a separate package after drying.

FIG. 3 shows a second embodiment of the system of the invention, in which the film package 17 is pipe-like in shape and also contains closing devices 18 for dividing the drying space 17 temporarily into sections. One part X of the film package then serves as an actual drying point and this part especially is in the effective field of the electrodes 1 and connected to equipment 6 for removing moisture. In this embodiment, the film package preferably has rigid walls, and the closing devices are arranged both to limit the film package into sections and to move the material 4 being dried from one section to another. Reference numeral 13 shows other possible inlets connected to the drying space X for measurements or for dosing gas or liquids into the drying space. A sectional drying space is advantageous when it is difficult to fit the entire film package into the effective field of the electrodes or the material needs to be dried in stages. Automatic material input and output apparatuses can also be arranged to the ends of the film package, whereby the material flow to be dried can be made continuous. A pipe-like film package can also be made into a circular structure, in which case the material to be dried goes round in the film package and a section of the material to be dried regularly enters the drying point X.

It is easier to make the required measurements in the drying method and system of the invention than in the prior art solutions, because when the material is in the high-frequency field, it is not surrounded by fixed and air-tight structures. After exiting the high-frequency field, the temperature and degree of moisture of the material can easily be measured for instance by IR gauges and radio wave field measurements. Due to the light film package, the mass of the material can be measured for the purpose of controlling the drying process for instance by means of the conveyor moving the package.

The drying system of the invention makes it possible to dry individual material pieces or large material quantities divided into suitable drying batches. The system is developed for drying wood in particular, but it can equally well be used to dry other solids, such as chips, sawdust, vegetable products, foodstuff, granulates, powders or materials created during production processes. The film package itself can be used for packing a piece or material batch of arbitrary shape, and the size and location of the electrodes can be altered in a versatile manner according to the packing size and shape of the material to be dried. The system of the invention is an inexpensive alternative for concentration processes of liquid products.

It is obvious to a person skilled in the art that the basic idea of the invention can be implemented in many different ways. The invention and its embodiments are thus not restricted to the examples described above, but can vary within the scope of the claims.

What is claimed is:

1. A method for drying material, in which method the material is dried by means of negative pressure and a high-frequency electromagnetic field generated by electrodes in a apace isolated from its surroundings, the method comprising the steps the material to be dried is fed into a separate drying space, the drying space is brought within the effective area of the electrodes and connected to equipment for removing moisture for the period of drying, after drying, the drying space is disconnected from the drying equipment to form a separate part.

2. A system for drying material, in which system the material is arranged to be dried in a space isolated from its surroundings, and in which the drying is arranged to take place by means of negative pressure and a high-frequency electromagnetic field generated by electrodes the system comprising a drying apace which is a separate film package and which can be brought within the effective area of the electrodes and removed from it, equipment for removing moisture that can be connected to the film package for the period of drying.

3. A system as claimed in claim 2, wherein the drying apace is formed by dividing film packages (2) suitable for the effective field of the electrodes (1) from a film pipe (10) to be filled with the material (4) to be dried.

4. A system as claimed in claim 2, wherein the film package comprises nozzles, and for the period of drying, the film package is arranged to be connected from the nozzles to the equipment for removing moisture released from the material.

5. A system as claimed in claim 2, wherein the equipment for removing moisture has an operating mode for generating negative pressure.

6. A system as claimed in claim 2, wherein after drying, the film package is arranged to be used for storage and transport.

7. A System as claimed in claim 2, wherein between the film package and the material to be dried, there is an additional material that is arranged to prevent the film from pressing against the material to be dried.

8. A system as claimed an claim 2, wherein one or more film packages containing material to be dried are arranged to pass between fixed electrodes (1).

9. A system as claimed in claim 2, wherein the electrodes are arranged to move in relation to one or more film packages containing material (4) to be dried.

10. A system as claimed in claim 2, wherein the shape of the film package corresponds to the shape of the material to be dried.

11. A system as claimed in claim 2, wherein the drying space is pipe-like and divided into sections by closing devices, and at least one section is arranged to be within the effective field of the electrodes and to connect to the equipment for removing moisture for the period of drying.

12. A system as claimed in claim 11, wherein the material to be dried is arranged to move inside the drying space (17) through said section.

13. A system as claimed in claim 2, wherein the material to be dried is wood.

* * * * *